US006302029B1

(12) United States Patent
Distelrath

(10) Patent No.: US 6,302,029 B1
(45) Date of Patent: Oct. 16, 2001

(54) VEHICLE FOR FAIRGROUND RIDES

(75) Inventor: Volker Distelrath, Dachau (DE)

(73) Assignee: Maurer Sohne GmbH & Co. KG, Munich (DE)

( * ) Notice: Subject to any disclaimer, the term of this patent is extended or adjusted under 35 U.S.C. 154(b) by 0 days.

(21) Appl. No.: 09/424,468

(22) PCT Filed: May 15, 1998

(86) PCT No.: PCT/EP98/02872

§ 371 Date: Jan. 27, 2000

§ 102(e) Date: Jan. 27, 2000

(87) PCT Pub. No.: WO98/56477

PCT Pub. Date: Dec. 17, 1998

(30) Foreign Application Priority Data

Jun. 9, 1997 (DE) ..... 197 24 272

(51) Int. Cl.[7] ..... A63G 23/00

(52) U.S. Cl. ..... 104/75; 188/185

(58) Field of Search ..... 104/53, 55, 56, 104/57, 62, 63, 64, 74, 75, 76, 77, 83, 85; 472/29, 31, 33, 36, 38, 40; 188/184, 185, 188, 186

(56) References Cited

U.S. PATENT DOCUMENTS 5,791,254 * 8/1998 Mares et al. ..... 104/53
6,098,549 * 8/2000 Mares ..... 104/76

FOREIGN PATENT DOCUMENTS 427891 4/1926 (DE) .
0778060 6/1997 (EP) .
392329 11/1908 (FR) .

* cited by examiner

*Primary Examiner*—Mark T. Le

(57) ABSTRACT

A vehicle, a vehicle for a fairground ride in particular, with an undercarriage (3) guided in a track (8) and a top carriage (2) arranged on said undercarriage (3) and rotatable with respect thereto, a damping device (9) for damping the relative movement between the top carriage and the undercarriage is provided for, is characterized in that said damping device (9) is constructed as centrifugal brake and/or a locking and/or alignment system (10, 11) controlled by said track (8) is provided for, which blocks or permits rotations of said top carriage (2) in relation to said undercarriage and/or aligns said top carriage (2) with respect to said undercarriage (1).

15 Claims, 4 Drawing Sheets

VEHICLE FOR FAIRGROUND RIDES

BACKGROUND OF THE INVENTION

1. Field of the Invention

This application is the national phase under 35 U.S.C. §371 of PCT International Application No. PCT/EP98/02872 which has an International filing date of May 15, 1998 which designated the United States of America.

The invention relates to a vehicle, a vehicle for a fairground ride in particular, with an undercarriage guided in a track and a top carriage arranged on said undercarriage and turnable with respect thereto, a damping device for damping the relative rotations between top carriage and undercarriage being provided for.

2. Related Art

Such a vehicle is known from DE 195 25 429 A1. In this vehicle, the eccentricity of the axial position and the damping effect are set in mutual functional dependency in accordance with a function of quality. During the passage of curves of a roll coaster-like track portion the top carriage is stimulated by the attacking centrifugal forces to a rotational movement about the vertical axial connection or the axial connection inclined to vertical, with respect to the undercarriage. The rotational movement is desired and serves for increasing fun in driving. The important point is that it takes place in controlled manner and that the passengers are not strained to much.

SUMMARY OF THE INVENTION

The invention aims at further developing the generic vehicle such that in simple manner control is possible of the relative movements occurring during passage of curves, between top carriage and undercarriage.

The invention achieves this aim by way of the subject matter set forth in the claims. As compared to the generic prior art, the damping device therein is constructed as centrifugal brake and/or a locking and/or alignment system controlled by the track is provided for, which system blocks or releases rotations of the top carriage with respect to the undercarriage and/or aligns the top carriage with respect to the undercarriage.

The construction of the damping device as centrifugal brake permits an automatic adaptation of damping to the respective curve geometry, since the embodiment of the centrifugal brake in accordance with the present invention without problem prevents excessively quick rotational movements of the top carriage with respect to the undercarriage depending on the centrifugal forces caused by the passage of the curves.

The stopping system fixes the relative alignment of top carriage and undercarriage with respect to one another such that rotations between top carriage and undercarriage are impossible. In this manner, the carriage goes from a straight into a curve with a constant radius. Because of the locking, top carriage and undercarriage have the same angular speed and in the initial portion of the curve experience angular acceleration. Thereafter, due to the constant radius the angular speed remains constant, too. In a given position of the curve now the connection or locking, respectively, between top carriage and undercarriage is released such that the top carriage can rotate independently from the undercarriage. This rotation is maintained also after passage of the curve, wherein the speed of rotation due to the respective position of the center of mass of the top carriage in the horizontal plane (i.e. the actual eccentricity) can still be (blown up) increased. The passenger, thus, will experience the surprising effect of a rotation in spite of the fact that due to the track geometry no rotation still had to be expected.

In order not to experience an excessively strong impact when releasing the locking device during entering the curve, loosening of the locking device can be deferred or extended over a definite period of time by slipping. This a.o. also is required, if due to the eccentric support and/or support inclined to vertical, of the top carriage with respect to the undercarriage the effect of rotation during passage of the curve is even increased by superimposed effects of gravitation and oscillation. Just in case of occurrence of such effects again the supplementary centrifugal brake is particularly meaningful.

In particularly preferred manner, the centrifugal brake for this purpose comprises at least two centrifugal weights mounted on the top carriage. The centrifugal brake is dimensioned thus that it acts only in case of rotations of the top carriage, it cannot, however, be activated by other forces acting on the carriage (e.g. by braking the undercarriage in the track or by passing a "valley" (also: trough) or a "peak" (also: dome)). For doing so the centrifugal brake is pretensioned or preadjusted such that it starts to act only after a defined fined threshold force.

A transmission device converts movements of the centrifugal weights into application movements of a brake shoe. The brake shoe preferably acts on the outer circumference of a brake ring arranged on the undercarriage. Furthermore, one or several spring(s) are provided for defining the actuation force of the centrifugal brake and/or for compensation of the friction which e.g. is caused by guide elements for the brake actuation. The diametrically opposed centrifugal weights are connected with suitable rods such that they can act in same direction to the outside or to the inside so that in case of cross forces in rest, in case of centrifugal forces due to the rotation cause a regulating force to the rods, which is used for braking.

During realization of the locking system, a toggle lever mechanism actuated by stop cams turned out to be particularly advantageous. For this purpose. a brake disk arranged in the top carriage is provided for, in addition the locking systems includes a lock brake activation arranged on the undercarriage, which again comprises the spring-biased toggle lever system with roller actuation.

A further, particularly preferred modification of the invention supplements the vehicle by an alignment system for aligning the top carriage with respect to the undercarriage—e.g. in the station area. Such an alignment system can in simple constructive manner be combined with the above-described toggle lever system for locking.

Further preferred embodiments of the invention can be taken from the remaining subclaims.

In the following, the invention will be described in more detail with reference to the drawing with reference to embodiments. In the drawing FIG. 1 is a schematic view of an embodiment of a centrifugal brake for a vehicle in accordance with the present invention;

FIG. 2*a* is a schematic view of an embodiment of a locking system and an alignment system for a vehicle in accordance with the present invention;

FIG. 2*b* is a sketch explaining the function of actuation and locking of the alignment system;

Figure 3:
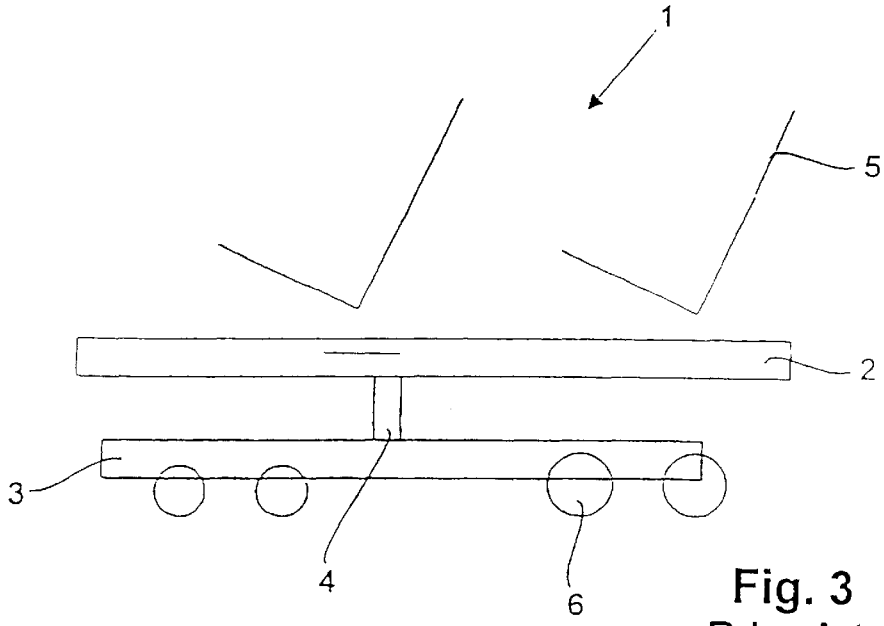
Fig. 3 Prior Art
FIG. 3 is a schematic view of a vehicle under prior art.
Figure 4:
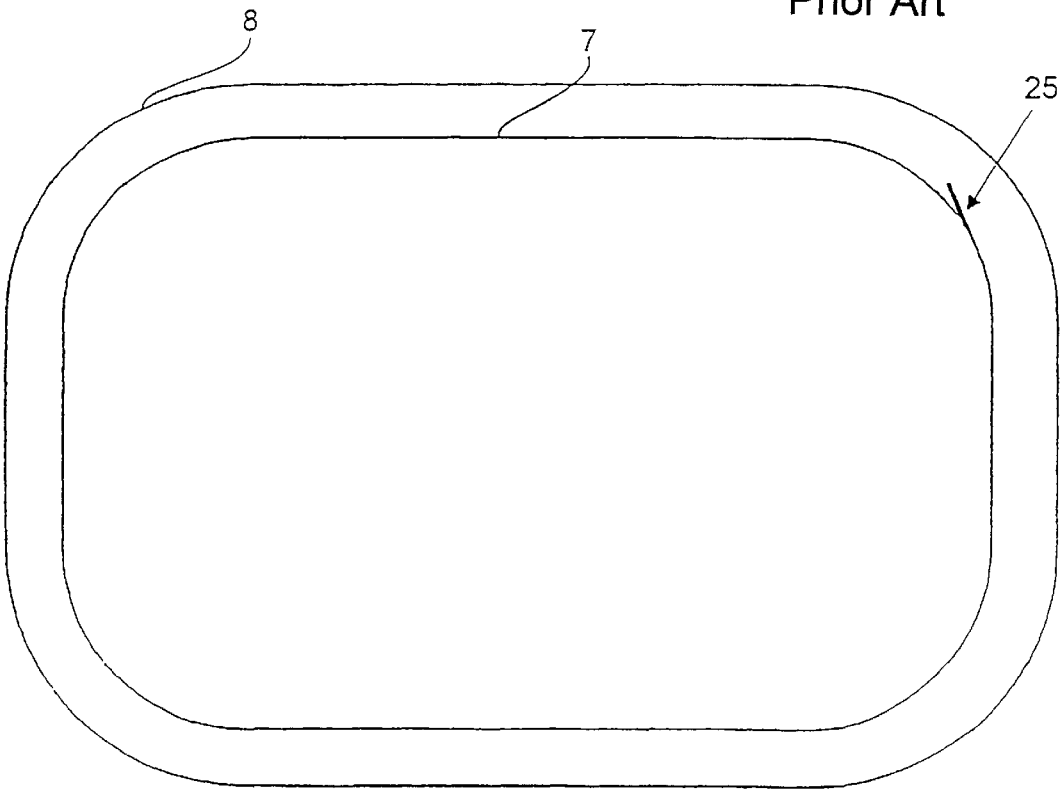
FIG. 4 is a schematic view of a simple track for a vehicle in accordance dance with the present invention.

At first, FIG. 3 will be described. FIG. 3 shows a vehicle 1 under prior art, which comprises a top carriage 2 and an undercarriage 3, said top carriage 2 being connected to said undercarriage 3 by a rotational axis 4. Said rotational axis 4 is eccentrically disposed with respect to the point of gravity of said top carriage 2. Said top carriage 2 comprises seats 5. Rail wheels 6 are constructed to guide said vehicle on rails 7 of a track 8 (see FIG. 4). In practice, said track 8 preferably is constructed in fairground ride manner.

Figure 1:
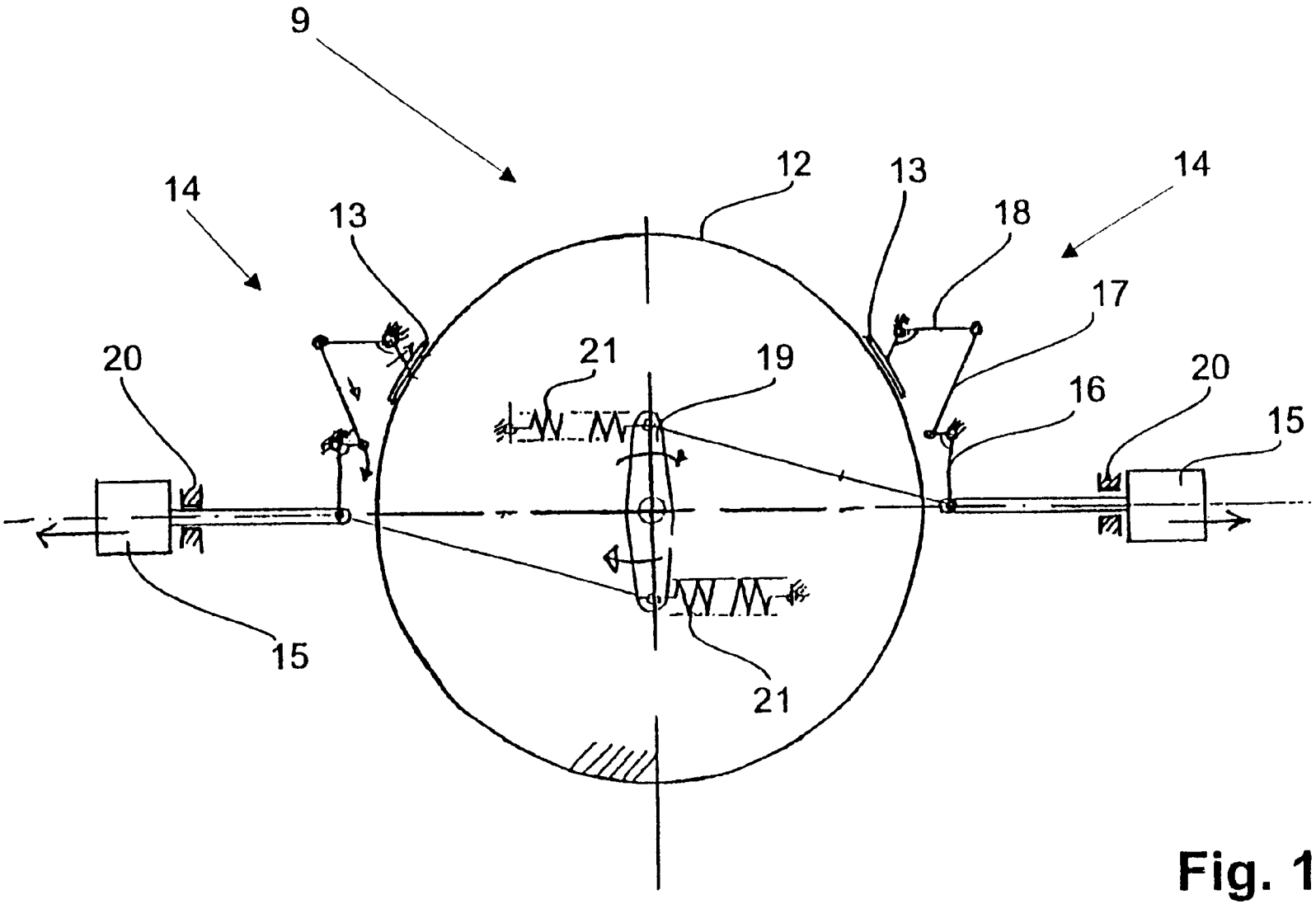

As compared to this prior art, the vehicle in accordance with the present invention distinguishes in that in the manner of FIG. 1 a damping device 9 is designed as centrifugal brake. In addition, a locking system 10 controlled by the tack and which blocks rotations of the top carriage with respect to the undercarriage and an alignment system 11 also controlled by the track and which aligns the top carriage 2 with respect to the undercarriage 1 are provided for (FIG. 2).

Said centrifugal brake includes a brake ring 12 arranged on said undercarriage in central position with respect to the rotational axis 4 and on whose outer circumference at least one brake shoe 13 can be activated. Through transmission means 14, said brake shoe or shoes 13 are connected to at least two centrifugal weights 15, said transmission means 14 converting movements of said centrifugal weights 15 in to activation movements of said brake shoes 13.

In case of an absolute rotation of said top carriage 2, said diametrically opposing centrifugal weights 15 are moved "to the outside" by centrifugal forces and transmit said centrifugal forces through the elements of said transmission device 14 (e.g. through an angle lever 16 and a connecting rod 17 to the brake lever 18 with brake shoe 13). By activation of the brake, the speed of rotation of the top carriage 2 is reduced.

Through the coupling rods 19 said two centrifugal weights 15 are synchronized and thus are connected such that linear accelerations and delays, i.e. cross forces of the top carriage, do not cause braking moments. The friction of guide elements 20 is compensated for by springs 21 which further serve for definition of the brake force (characteristic curve of the springs) or for definition of a minimum force in excess of which activation movement will take place.

Figure 2A:
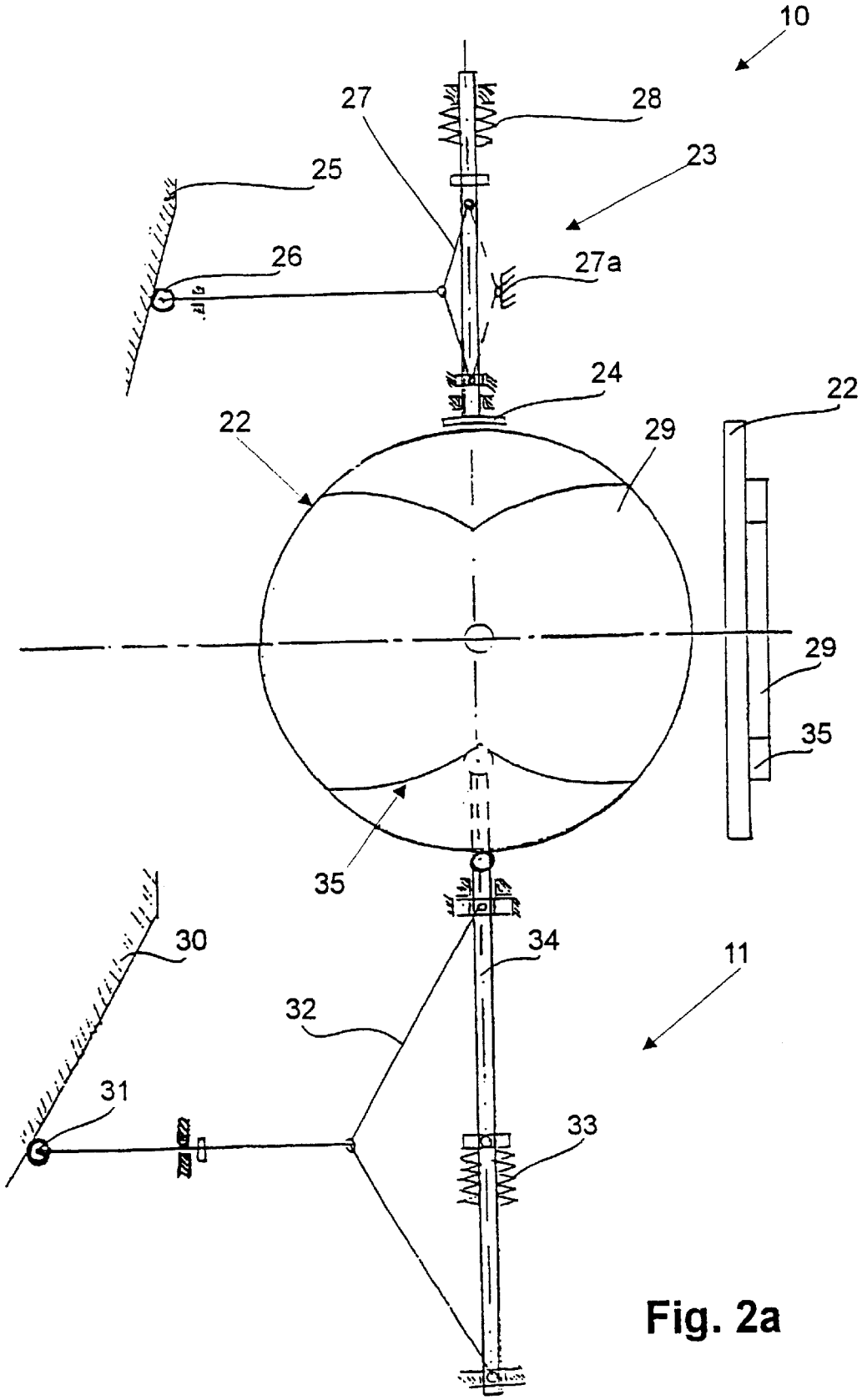

The locking system under FIG. 2*a* includes a brake disk 22 mounted on said top carriage 2. Thereagainst a lock braking activation 23 located on said undercarriage 3 activates at least one brake shoe 24.

A roll 26 moved by a stop cam 25 (see FIG. 2) mounted on said track 8 (e.g. above or laterally to said rails 7) actuates and tensions a spring 28 by a toggle lever system 27. In tensioned state said brake shoe or brake block 24 is lifted from said brake disk 22. By pull action to the roll 26 the spring set 28 is set free, which presses said brake block 25 to said brake disk 22. By releasing the activation of said brake block 25 locking between top carriage and undercarriage is cancelled and the top carriage can rotate freely. The release and activation movements are started by opposingly aligned cams. A stop 27*a* of said toggle lever rods 27 in excess of the dead center of the activation movement causes a rest position of the brake in released state.

Figure 2B:
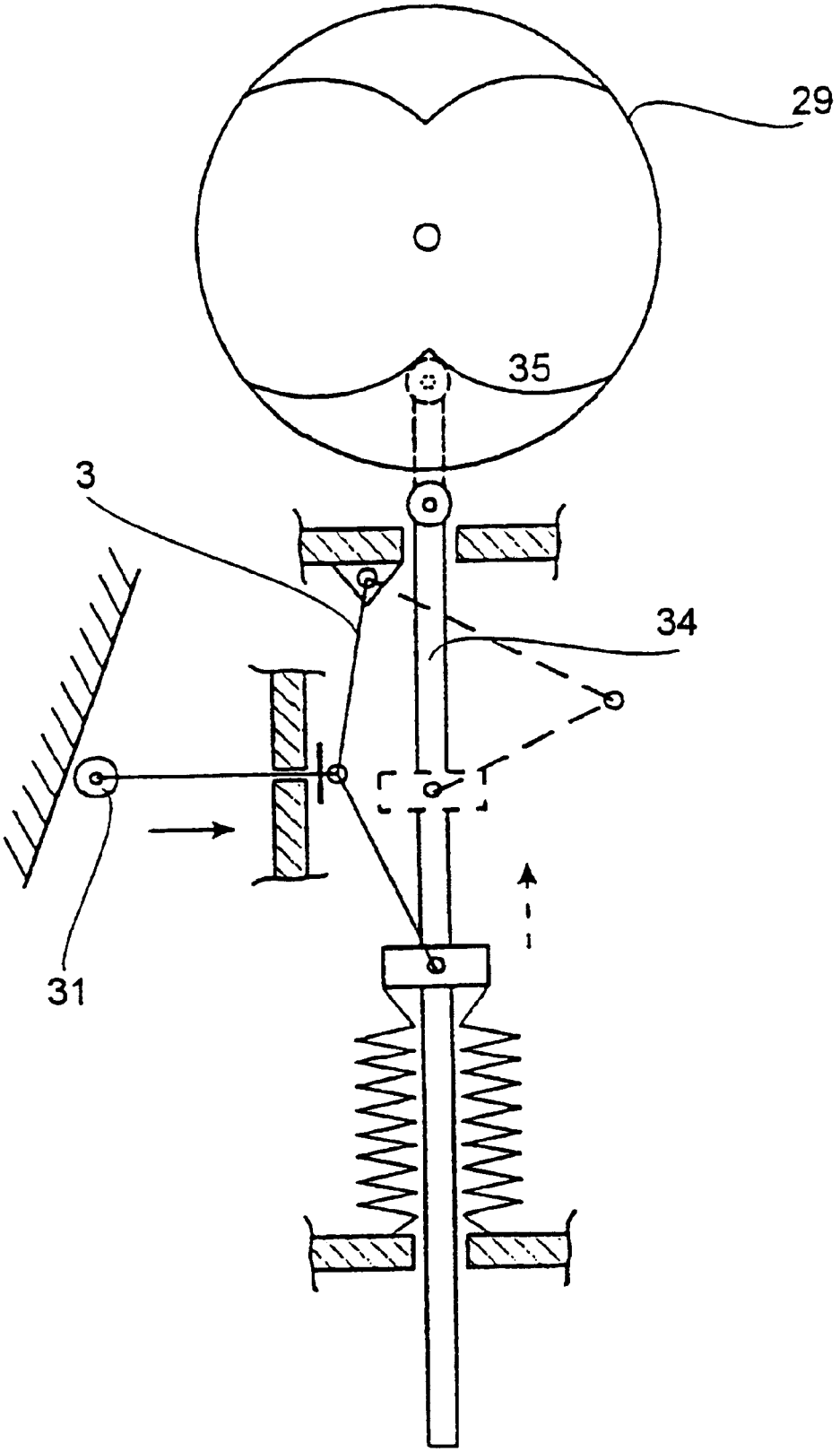

In stations and possibly also in certain track sections furthermore the alignment system 11 is used (see also FIG. 2*b*). A particular alignment disk 29 for this purpose also is arranged on said top carriage in axial relation to said brake disk 22. A roll 31 moved by a stop cam 30 mounted on said track 8 (e.g. above said rails 7) activates and tensions a spring 32 by a toggle lever system 32. In tensioned state a locking pin 34 is in a position remote from the axis of rotation of said disk 29. Caused by pressure to the roll 31 the spring set 33 which moves said pin 34 is set free. By "activation" of the pin 34 said pin is pressed into one of two heart-shaped recesses 35, this aligning the vehicle in a 180 degree position. In addition, a stop brake (stop inclination) supporting the alignment (see FIG. 2*b*) can be provided for in the area of the station (not shown).

What is claimed is:

1. A vehicle, for use in a fairground ride, having an undercarriage (3) guided in a track (8), a top carriage (2) mounted on said undercarriage (3) and rotatable with respect thereto, and a damping device (9) for damping relative movements between the top carriage and the undercarriage, wherein said damping device (9) is a centrifugal brake actuated primarily by a centrifugal force.

2. The vehicle as defined in claim 1, wherein said centrifugal brake comprises at least two centrifugal weights (15) mounted on said top carriage (2).

3. The vehicle as defined in claim 2, wherein a transmission device (14) is provided for, which converts movements of said centrifugal weights (15) in activation movements of a brake shoe (13).

4. The vehicle as defined in claim 1, wherein two diametrically opposing centrifugal weights (15) are mounted to said top carriage (2), and said centrifugal weights (15) are connected with coupling rods (19) only permitting movement of said weights in in-and out directions.

5. The vehicle as defined in claim 1, wherein a brake ring (12) is arranged on said undercarriage.

6. The vehicle as defined in claim 3, wherein said transmission device (14) includes an angle lever (16) and/or a connecting rod (17) and/or a brake lever (18).

7. The vehicle as defined in claim 4, wherein said coupling rods (19) also are provided for synchronization of an activation movement of two or several brake shoes (13).

8. The vehicle as defined in claim 1, wherein at least one spring (21) is provided for definition of an actuation force of said centrifugal brake and/or for compensation of friction caused by guide elements (20) of a brake activation.

9. The vehicle as defined in claim 1, wherein a locking system (10) controlled by said track (8) is provided for, which blocks or permits rotations of the top carriage (2) in relation to said undercarriage (3).

10. The vehicle as defined in claim 9, wherein said locking system includes a lock braking actuation (23) arranged on said undercarriage.

11. The vehicle as defined in claim 10, wherein said lock braking actuation (23) includes a spring-biased toggle lever system (27) with roll activation.

12. The vehicle as defined in claim 10, wherein a stop cam (25) arranged on said track (8) is provided for as an activation element of the lock braking actuation.

13. The vehicle as defined in claim 1, wherein an alignment system (11) controlled by said track (8) is provided for, which aligns said top carriage (2) with respect to said undercarriage.

14. The vehicle as defined in claim 13, wherein said alignment system comprises a spring-biased toggle lever system (32) with roll actuation and a locking pin (34) which engages with a recess (35).

15. The vehicle as defined in claim 13, wherein stop cams (30) arranged on said track are provided for as an activation element (30) of said alignment system.

* * * * *